US008094083B1

(12) United States Patent
Tam et al.

(10) Patent No.: US 8,094,083 B1
(45) Date of Patent: Jan. 10, 2012

(54) MULTI-BAND TREE ANTENNA

(75) Inventors: Daniel W. S. Tam, San Diego, CA (US); John W. Rockway, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 531 days.

(21) Appl. No.: 12/330,307

(22) Filed: Dec. 8, 2008

(51) Int. Cl.
*H01Q 7/08* (2006.01)

(52) U.S. Cl. ..... 343/788

(58) Field of Classification Search ..... 343/788, 343/895
See application file for complete search history.

(56) References Cited

U.S. PATENT DOCUMENTS

| | | | | |
|---|---|---|---|---|
| 3,400,402 | A * | 9/1968 | Gallagher et al. | 343/723 |
| 3,646,562 | A * | 2/1972 | Acker et al. | 343/720 |
| 3,701,057 | A * | 10/1972 | Hoer | 333/112 |
| 3,932,873 | A * | 1/1976 | Garcia | 343/792 |
| 4,467,293 | A * | 8/1984 | Apel | 333/112 |
| 5,633,648 | A * | 5/1997 | Fischer | 343/788 |
| 6,492,956 | B1 * | 12/2002 | Fischer et al. | 343/788 |
| 7,898,484 | B1 * | 3/2011 | Tam | 343/701 |

OTHER PUBLICATIONS

"Signal Propagation at 400kHz Using an Oak Tree with a HEMAC as an antenna", Army Electronics Command Monmouth NJ Nov. 1971, pp. 137-140.*

"Trees Performing as Radio Antennas", IEEE Transaction on Antennas and Propagation, Jan. 1975. Kurt Ikrath et al., pp. 1-17.*

Author Unknown; A Tree Antenna for the 600 Meter Band, http://www.w5jgv.com/tree_antenna/index.htm, dated Sep. 8, 2007, last viewed Dec. 8, 2008.

Squier, George O.; Tree Antennas, Scientific American, Jul. 14, 1919, p. 624, viewed at http://www.rexresearch.com/squier/squier.htm on Dec. 8, 2008.

Unpublished U.S. Appl. No. 11/867,046, filed Oct. 4, 2007 by Daniel Tam et al., titled "Multiband Current Probe Fed Antenna."

Unpublished U.S. Appl. No. 12/119,302, filed May 12, 2008 by Daniel Tam titled "Electrolytic Fluid Antenna."

John H. Meloling, James H. Schukantz Jr., & Joseph Fischer; A Transmit Mast-Clamp Current Probe for Shipboard HF Communications; IEEE 0-7803-8883-6/05, pp. 17-20, 2005.

Michael Stewart; The Ship as Antenna; Military Information Technology Online Archives, vol. 8, Issue 10, Dec. 22, 2004.

* cited by examiner

*Primary Examiner* — Huedung Mancuso
(74) *Attorney, Agent, or Firm* — Kyle Eppele; J. Eric Anderson

(57) ABSTRACT

A multi-band antenna comprising a tree and a plurality of current probes coupled around the tree. Each current probe is designed to receive and transmit in a substantially different frequency band than the other current probes. The current probes are positioned on the tree so as to effectively create a plurality of transmit/receive antennas such that each respective antenna has a voltage standing wave ratio (VSWR) of less than or equal to approximately 3:1 for a given range within each respective frequency band.

12 Claims, 5 Drawing Sheets

MULTI-BAND TREE ANTENNA

FEDERALLY-SPONSORED RESEARCH AND DEVELOPMENT

This invention is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case Number 98608.

BACKGROUND OF THE INVENTION

With increasing numbers of wireless communications systems available today more and more antennas are required to support them. In many situations the available real estate limits the number of additional antennas that may be added to a site. For example, the area available on building rooftops, and exterior surfaces of automobiles, aircraft, and sea craft, which often serve as antenna placement locations, is particularly limited.

BRIEF DESCRIPTION OF THE DRAWINGS

Throughout the several views, like elements are referenced using like references. Figures are not drawn to scale.

DETAILED DESCRIPTION OF EMBODIMENTS

Glossary of Terms/Abbreviations

| | |
|---|---|
| BALUN: | balanced to unbalanced transformer |
| BNC Connector: | bayonet Neill-Concelman coaxial cable connector |
| EMI: | electromagnetic interference |
| HF: | High Frequency (HF) range (2-30 MHz) |
| L-Band: | (1000-2000 MHz) |
| MHz: | Megahertz |
| SMA Connector: | SubMiniature version A coaxial cable connector |
| TNC Connector: | threaded Neill-Concelman coaxial cable connector |
| UHF: | Ultra High Frequency (300-1000 MHz) |
| UNUN: | unbalanced to unbalanced transformer |
| VHF: | Very High Frequency (30-300 MHz) |
| VSWR: | voltage standing wave ratio |

Figure 1:
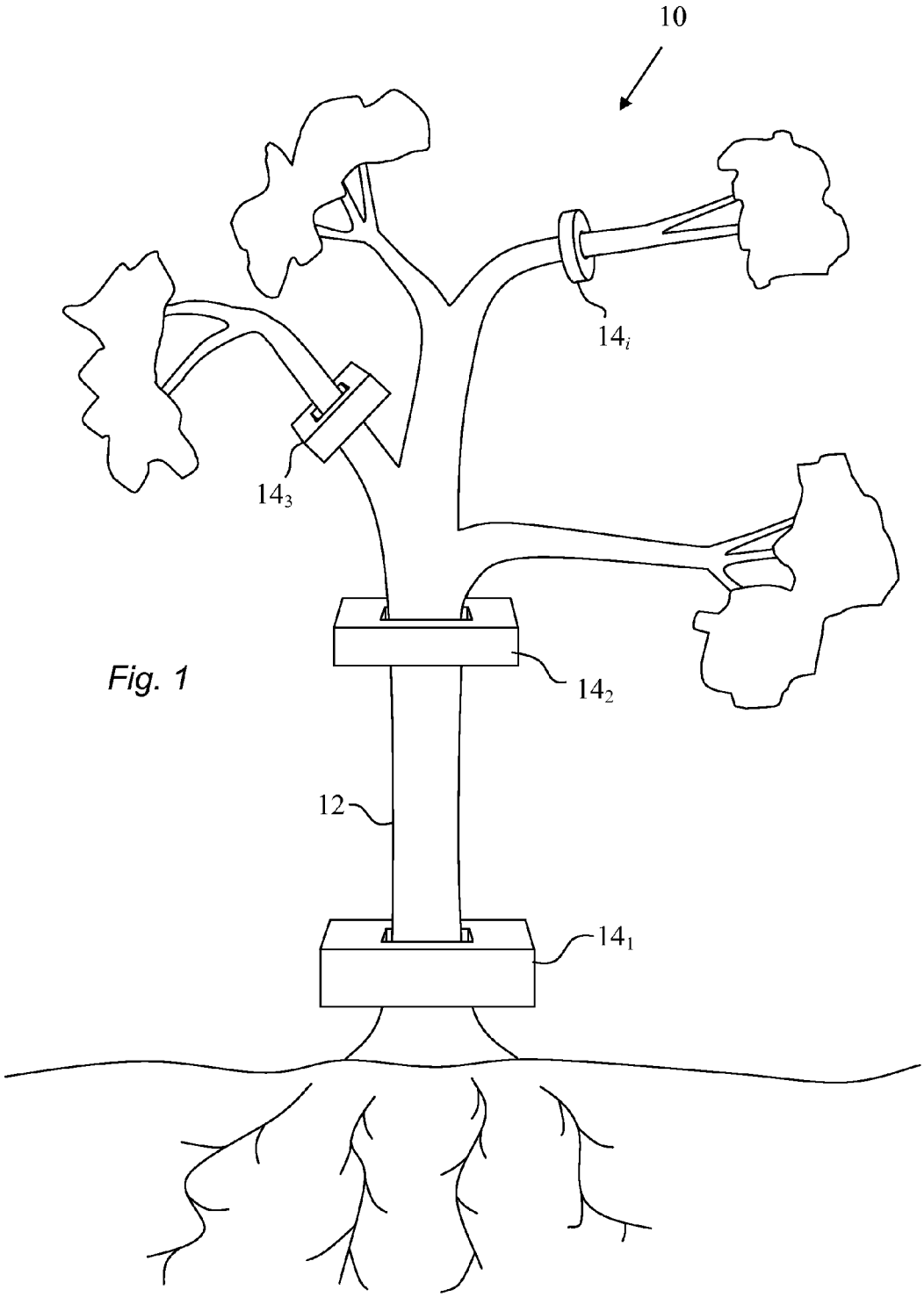
FIG. 1 is a perspective view of a multi-band tree antenna.

FIG. 1 shows an embodiment of a multi-band tree antenna 10 that comprises a live tree 12, and a plurality of current probes $\mathbf{14}_1$-$\mathbf{14}_i$ coupled around the tree 12, where i is an index. Each current probe 14 is designed to receive and transmit in a substantially different frequency band than the other current probes 14. The current probes 14 are positioned on the tree 12 so as to effectively create a plurality of transmit/receive antennas such that each respective antenna has a voltage standing wave ratio (VSWR) of less than or equal to approximately 3:1 for a given range within each respective frequency band. It is to be understood that even though 4 current probes 14 are shown in FIG. 1, the multi-band tree antenna 10 is not limited to 4 current probes but may have any number of current probes. The tree 12 may be any living tree that is capable of supporting the current probes 14.

Figure 2A:
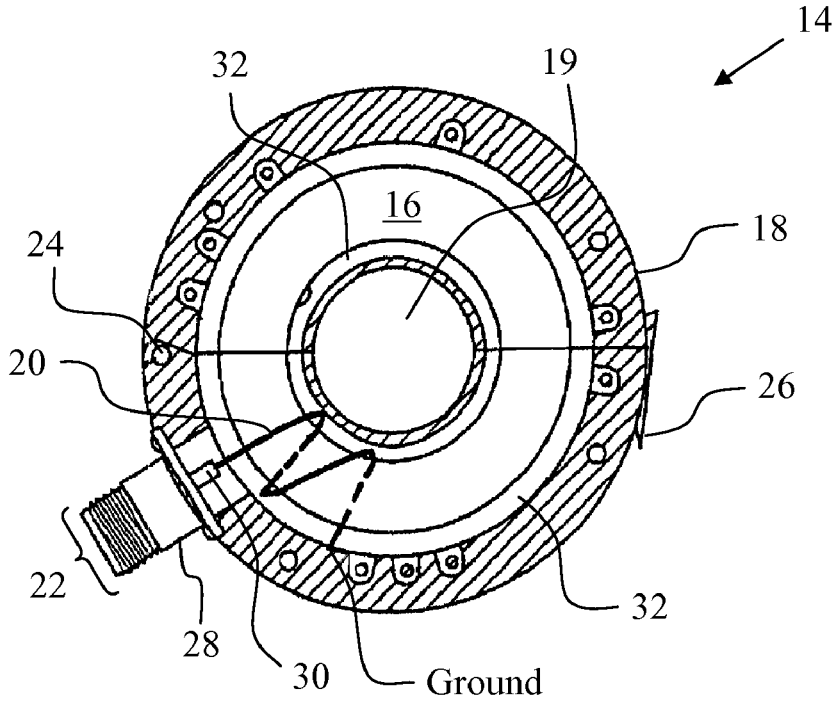
FIG. 2A shows a horizontal cross-sectional view of a current probe.
Figure 2B:
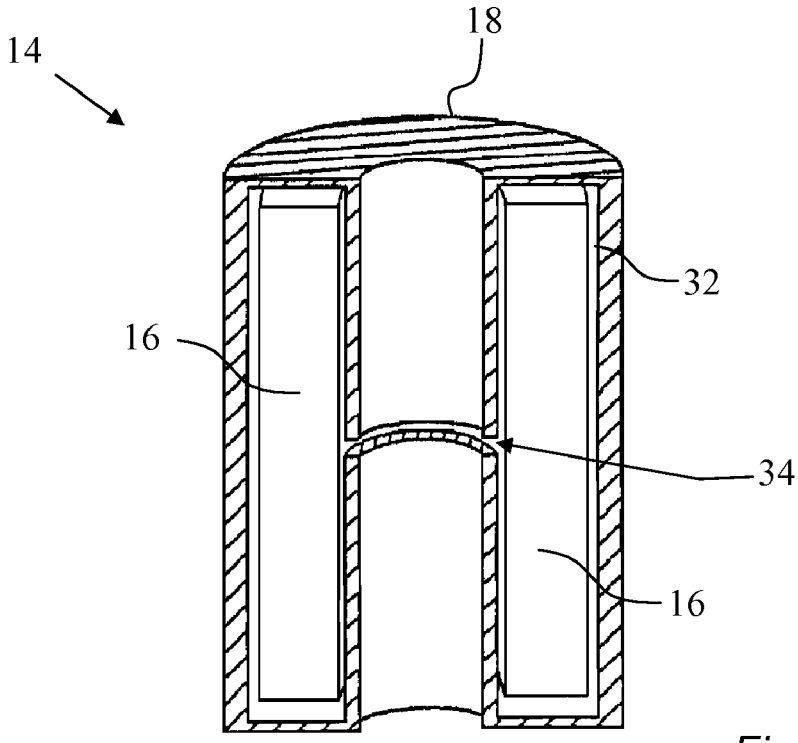
FIG. 2B shows a vertical cross-sectional view of a current probe.

As shown in FIGS. 2A and 2B, each current probe 14 comprises a ferrite core 16, a nonmagnetic, metallic housing 18, and an aperture 19. Because the core 16 is made out of ferrite material, each current probe 14 acts as a choke to out-of-band currents on the tree. Therefore, no antenna traps are required for the multi-band tree antenna 10. In-band, each current probe 14 couples to the tree 12 such that a part of the tree 12 passes through the center aperture 19. Coupling the current probes 14 to the tree 12 in this manner effectively creates a broadband antenna. Each ferrite core 16 has the shape of a toroid or its topological equivalent. Each current probe 14 may be designed for a different operating band. For example, one embodiment of the multi-band tree antenna 10 may comprise a first current probe 14 designed to transmit and receive in the High Frequency (HF) range (2-30 MHz), a second current probe 14 designed to operate in the Very High Frequency (VHF) range (30-300 MHz), a third current probe 14 designed to operate in the Ultra High Frequency (UHF) range (300-1000 MHz), and a fourth current probe 14 designed to operate in the L-band range (1000-2000 MHz). Each current probe 14 may be positioned on the tree 12 such that each current probe 14's VSWR is less than or equal to approximately 3:1 within its operating range. By carefully placing the current probes 14 on the tree 12, one can effectively create a plurality of transmit/receive monopole antennas. The housing 18 may be any size or shape that is capable of containing the ferrite core 16. The current probes 14 may be placed around the trunk or branches of the tree 12 as shown in FIG. 1.

Figure 3:
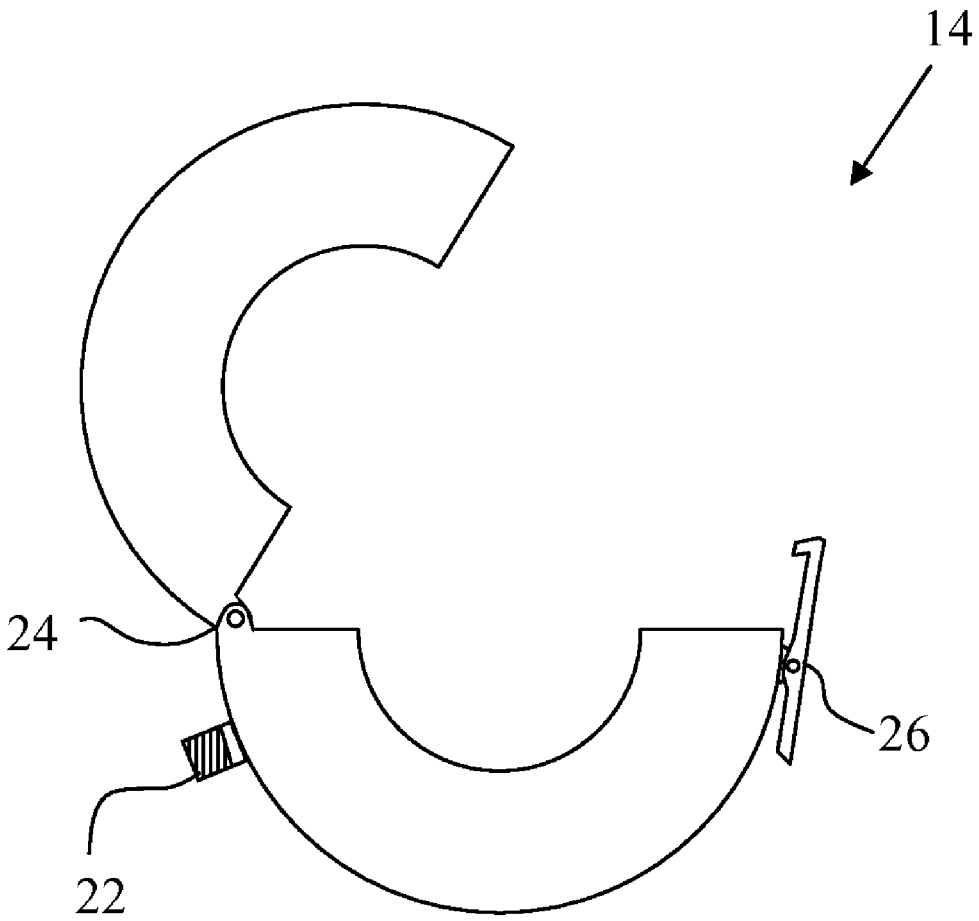
FIG. 3 shows an illustration of a current probe in an open position.

FIGS. 2A, 2B, and 3 show multiple views of one embodiment of the current probe 14. FIG. 2A shows a horizontal cross-section exposing the relationship of the ferrite core 16 and its primary winding 20 to the housing 18 and a feed connector 22. FIG. 2B shows a vertical cross-section of one half of the current probe 14. In FIG. 2B, the ferrite core 16 is split lengthwise into two halves. FIGS. 2A and 3 show the features that allow one embodiment of the current probe 14 to be clamped around a tree 12. A hinge 24 allows this embodiment of the current probe 14 to be hinged open and positioned around the tree 12. In this embodiment, a releasable latch 26 allows the two core halves to be latched together. FIG. 3 shows an embodiment of the current probe 14 in an open position.

As shown in FIG. 2A, the ferrite core 16 and primary winding 20 are contained within the housing 18. The ferrite core 16 may be comprised of any suitable magnetic material with a high resistivity. The primary winding 20 may be wound around the ferrite core 16 for a plurality of turns. The number of turns of the primary winding 20 and the ferrite core 16 materials will provide different inductive and resistive characteristics, affecting the frequency response and thus the insertion loss of the device. The primary winding 20 may consist of a single turn around the ferrite core 16 or several turns around the ferrite core 16. The primary winding 20 may cover only one half of the ferrite core 16, or may extend around both core halves. The primary winding 20 may be terminated with a connection to the housing 18 as a ground, or it can be terminated in a balanced to unbalanced transformer (typically referred to as a BALUN) as described below. For transmitting, an RF signal is coupled into the current probe 14 through the feed connector 22. Examples of the feed connectors 22 include, but are not limited to: BNC (bayonet Neill-Concelman), SMA (SubMiniature version A), TNC (threaded Neill-Concelman), and N-style coaxial connectors. If a coaxial connector is used, the shield 28 portion of the connector 22 is coupled to the housing 18, while the inside conductor 30 of the connector 22 is coupled to the primary winding 20. The primary winding 20 is terminated with a connection to the housing 18. The primary winding 20 and ferrite core 16 may be insulated from the housing 18 by an electrical insulating layer 32. The insulating layer 32 may comprise any suitable electrical insulating materials. The core halves of the ferrite core 16 are generally in contact with each other when the current probe 14 is closed, but, in some instances, an intentional air gap may separate the core halves. However, even when the core halves are in contact with each other, a minute air gap may still exist even though the core faces may be polished to a very smooth finish and pressed tightly against one another. This air gap will result in air gap losses. The so-called air gap loss does not occur in the air gap itself, but is caused by the magnetic flux fringing around the gap and reentering the core in a direction of high loss. As the air gap increases, the fringing flux continues to increase, and some of the fringing flux strikes the core perpendicular to the core, and sets up eddy currents. Core materials with high resistivity may reduce these currents.

FIG. 2B shows a space gap 34 within the interior portion of the housing 18. This space gap 34 may be used to prevent forming a shorted tertiary turn around the primary winding 20. If no space gap 34 were present, the shorted turn of the shield 28 would prevent the current probe 14 from coupling RF current to and from the tree 12. The embodiment of the current probe 14 shown in FIGS. 2A and 2B may be clamped around a tree 12. For transmitting, current flow in the primary winding 20 induces a magnetic field with closed flux lines substantially parallel to the ferrite core 16. This magnetic field then induces current flow in the tree 12 clamped within the current probe 14, which results in RF energy radiation. A transmission line transformer may be used to couple the RF energy from a transmitter to the current probe 14. If the primary winding 20 is terminated to the housing 18, an unbalanced to unbalanced (UNUN) transmission line transformer may be used to couple RF energy to the input end of the primary winding 20 of the current probe 14. A balanced to unbalanced transformer (BALUN) may alternatively be used to couple RF energy to the current probe 14. In this configuration, the primary winding 20 may not be terminated at the housing 18. Instead, both the input end and the termination of the primary winding 20 may be connected to the balanced terminals of a BALUN. The unbalanced ends of the BALUN may be connected to a coaxial cable carrying the RF energy from a transmitter. A BALUN may also be used if the RF current injector has no external shield connected to ground. Both BALUNs and UNUNs are well known in the art and are commercially available. However, specially made UNUNs may be required to properly match a transmitter output to the input of the current probe 14. Although FIGS. 2A and 2B show the current probe 14 as configured to clamp around the tree 12, it is to be understood that the manner of mounting the current probe 14 to the tree 12 is not limited to clamping, but any effective manner of positioning the current probe 14 around the tree 12 may be used.

Figure 4:
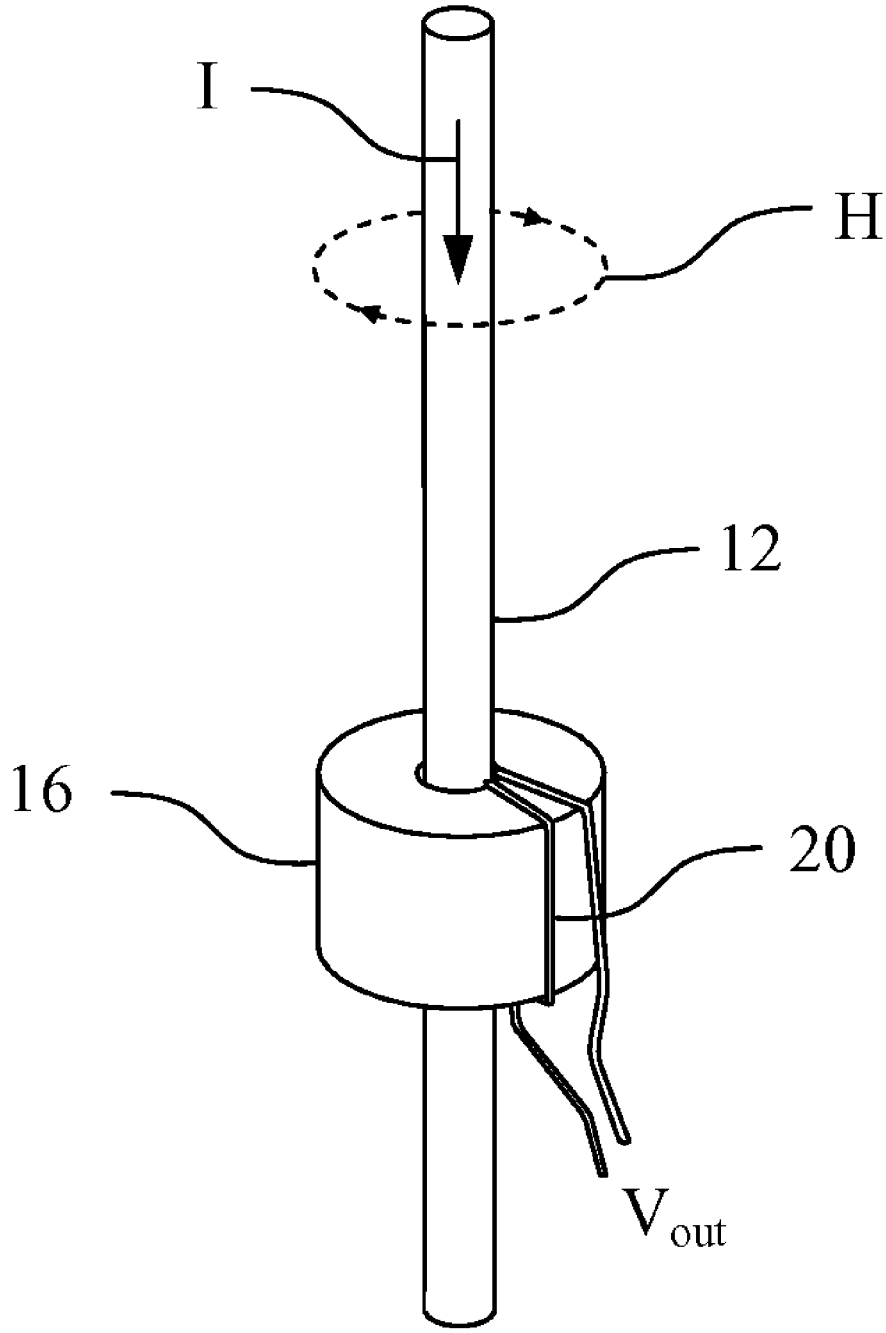
FIG. 4 is illustrates an operational concept of an embodiment of a current probe.

FIG. 4 illustrates an operational concept of the current probes 14. In the receive mode, an external electric field induces current (I) on the tree 12. The current (I) may be coupled from the tree 12 via the current probe 14 transfer impedance to the input of a receiver or multi-coupler. The current probe 14 may be designed such that the current probe 14 will produce a desired transfer impedance $Z_t$ over the frequency range of interest and provide the required out-of-band rejection from a co-located transmit system to protect the receive system from damage or electromagnetic interference (EMI) problems. In this instance, the transfer impedance $Z_t=V_{out}/I_{in}$. For transmitting, the primary winding 20 may generate high magnetic fields (H) in the ferrite core 16. This magnetic field (H), which equals $I/2\pi r$, where "r" is the radial distance from the center of the tree 12 to the field point, induces current (I) on the tree 12, which then radiates the energy.

Initial placement location of each current probe 14 on the tree 12 may be determined by using the length of a ¼-wavelength monopole antenna over a certain band from the following equation:

$$\text{¼-wavelength}=\lambda/4=c/4f$$

$\lambda$=wavelength (m)
c=speed of light ($300\times10^6$ m/s)
f=frequency (Hz)

For example, the current probes 14 may be initially arranged on the tree 12 utilizing the total height of the tree 12 with the lowest-frequency current probe 14 positioned near the base of the tree 12. Then, each current probe 14 may be "tuned" by moving the current probe 14 up and down the tree 12 or its various branches until the approximately lowest VSWR is achieved. This process then repeats for the next-higher-frequency current probe 14. After each current probe 14 has been initially placed, the VSWR corresponding to each current probe 14 may be measured again. To compensate for minor impedance coupling interaction between the tree branches and the current probes 14, the positions of all the current probes 14 may be adjusted again, following the above procedure, until satisfactory VSWR performance is achieved for each current probe 14.

Figure 5:
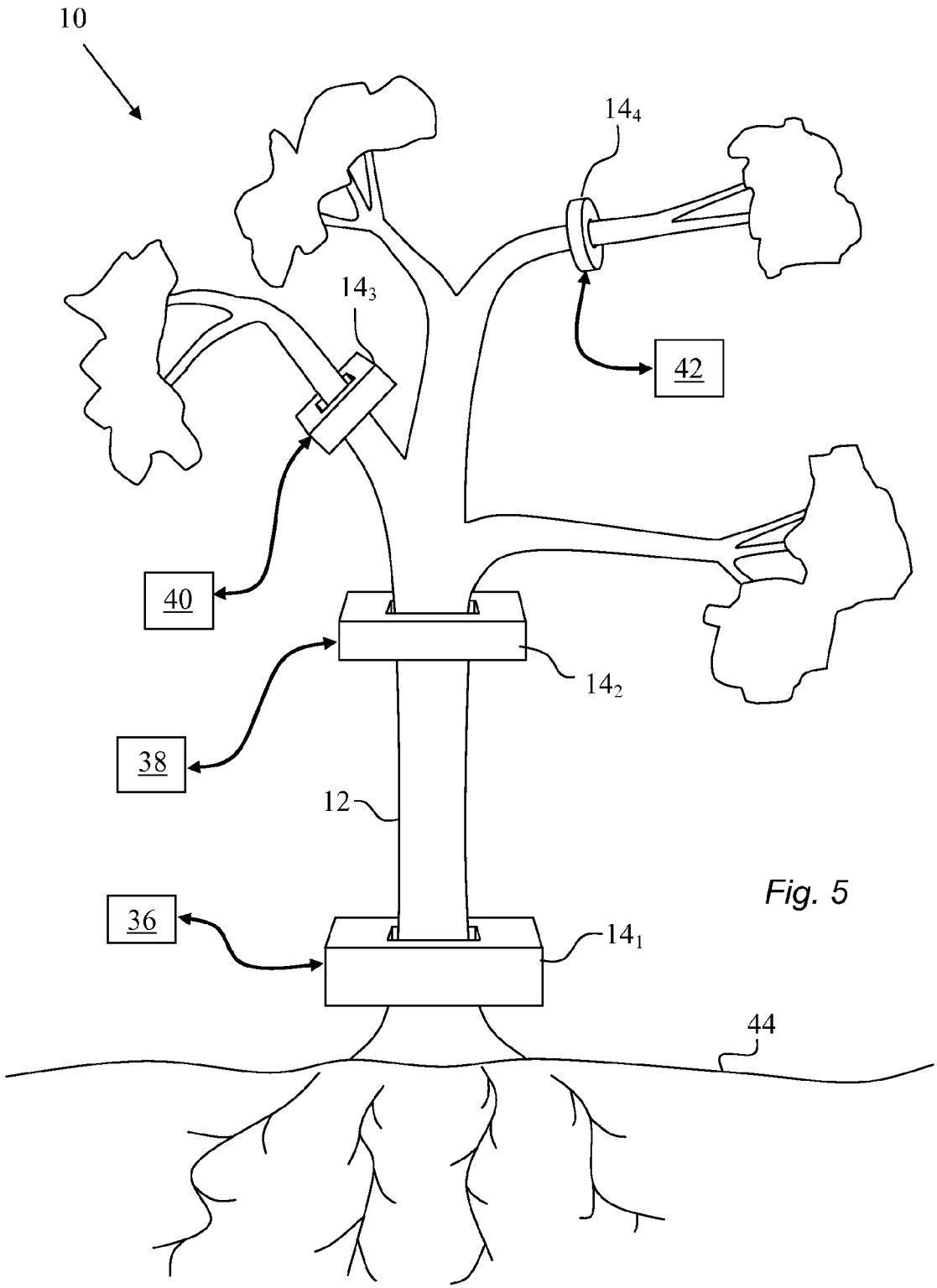
FIG. 5 shows another perspective view of the multi-band tree antenna.

FIG. 5 shows a perspective view of one embodiment of the multi-band tree antenna 10. In FIG. 5, the multi-band tree antenna 10 comprises a first current probe $\mathbf{14}_1$ designed to transmit and receive in the HF range (2-30 MHz), a second current probe $\mathbf{14}_2$ designed to operate in the VHF range (30-300 MHz), a third current probe $\mathbf{14}_3$ designed to operate in the UHF range (300-1000 MHz), and a fourth current probe $\mathbf{14}_4$ designed to operate in the L-band range (1000-2000 MHz). As shown in FIG. 5, the first current probe $\mathbf{14}_1$ may be coupled to a HF transceiver 36. The second current probe $\mathbf{14}_2$ may be coupled to a VHF transceiver 38. The third current probe $\mathbf{14}_3$ may be coupled to a UHF transceiver 40. The fourth current probe $\mathbf{14}_4$ may be coupled to a L-band transceiver 42. In this fashion, the tree 12 behaves as the antenna element and the ground 44 that the tree grows out of functions as the antenna ground.

From the above description of the multi-band tree antenna 10, it is manifest that various techniques may be used for implementing the concepts of the multi-band tree antenna 10 without departing from the scope of the claims. The described embodiments are to be considered in all respects as illustrative and not restrictive. It should also be understood that the multi-band tree antenna 10 is not limited to the particular embodiments described herein, but is capable of many embodiments without departing from the scope of the claims.

We claim:

1. A multi-band antenna comprising:

a live tree;

a plurality of current probes coupled around the tree;

wherein each current probe is designed to receive and transmit in a substantially different frequency band than the other current probes, and wherein the current probes are positioned on the tree so as to effectively create a plurality of transmit/receive antennas such that each respective antenna has a voltage standing wave ratio (VSWR) of less than or equal to approximately 3:1 for a given range within each respective frequency band.

2. The multi-band antenna of claim 1, wherein each current probe comprises a toroidal, ferrite core with a center aperture, wherein the current probe is positioned such that the tree passes through the center aperture of each current probe.

3. The multi-band antenna of claim 2, wherein each current probe further comprises an outer conducting non magnetic housing that is insulated from the core.

4. The multi-band antenna of claim 3, wherein each current probe further comprises a primary winding wound about the core.

5. The multi-band antenna of claim 4, wherein each of the plurality of transmit/receive antennas is effectively a monopole antenna.

6. The multi-band antenna of claim 1, wherein each of the plurality of transmit/receive antennas is effectively a monopole antenna.

7. The multi-band antenna of claim 6, wherein the plurality of current probes comprises at least four current probes, wherein at least one of the current probes is designed to transmit and receive in one of the following frequency bands:

1000 MHz-2000 MHz (L-band);

300-1000 MHz (UHF);

30-300 MHz (VHF); and 2-30 MHz (HF).

8. The multi-band antenna of claim 6, wherein each current probe further comprises two halves hingedly connected to each other such that each current probe is configured to be clamped around the tree.

9. A multi-band antenna comprising:

a live tree;

a plurality of current probes, each current probe having a center aperture, wherein the current probes are coupled to the tree such that part of the tree extends through the aperture of each current probe;

wherein at least one current probe is designed to receive and transmit in the HF, VHF, UHF, and L frequency bands, and wherein the current probes are positioned on the tree without the use of antenna traps so as to effectively create a plurality of transmit/receive antennas such that each respective antenna has a voltage standing wave ratio (VSWR) of less than or equal to approximately 3:1 within each respective frequency band.

10. The multi-band antenna of claim 9, wherein the plurality of current probes comprises first, second, third, and forth current probes, each one designed to respectively transmit and receive in the frequency band of 2-30 MHz, 30-300 MHz, 300-1000 MHz and 1000-2000 MHz.

11. The multi-band antenna of claim 10, wherein each of the transmit/receive antennas is effectively a monopole antenna.

12. The multi-band antenna of claim 11, wherein each current probe further comprises two halves hingedly connected to each other such that the current probe is configured to be clamped around the tree.

* * * * *